US008603140B2

(12) United States Patent
Nipp

(10) Patent No.: US 8,603,140 B2
(45) Date of Patent: Dec. 10, 2013

(54) PACIFIER

(76) Inventor: Nicole Nipp, Balzers (LI)

( * ) Notice: Subject to any disclaimer, the term of this patent is extended or adjusted under 35 U.S.C. 154(b) by 211 days.

(21) Appl. No.: 13/190,613

(22) Filed: Jul. 26, 2011

(65) Prior Publication Data

US 2012/0022589 A1 Jan. 26, 2012

(30) Foreign Application Priority Data

Jul. 26, 2010 (AT) ..... GM470/2010

(51) Int. Cl.
*A61J 17/00* (2006.01)

(52) U.S. Cl.
USPC ..... 606/234

(58) Field of Classification Search
USPC ..... 604/77; 606/234, 235, 236; 215/11.1, 215/11.2, 11.3, 11.4, 11.5, 11.6
See application file for complete search history.

(56) References Cited

U.S. PATENT DOCUMENTS

| | | | | |
|---|---|---|---|---|
| 3,669,117 | A * | 6/1972 | Herbst | 606/235 |
| 3,875,940 | A * | 4/1975 | Beuther | 604/77 |
| 4,192,307 | A * | 3/1980 | Baer | 606/236 |
| 4,949,731 | A | 8/1990 | Harding | |
| 4,950,286 | A | 8/1990 | Meussdoerffer | |
| 5,395,392 | A * | 3/1995 | Suhonen | 606/234 |
| 5,571,140 | A * | 11/1996 | Gura-Emerling | 606/236 |
| 6,241,110 | B1 * | 6/2001 | Hakim | 215/11.1 |
| 6,447,536 | B1 * | 9/2002 | Hinshaw | 606/235 |
| 2002/0122832 | A1 | 9/2002 | Hanke et al. | |
| 2004/0210252 | A1 * | 10/2004 | Minoguchi et al. | 606/234 |
| 2004/0215234 | A1 * | 10/2004 | McCardell | 606/235 |
| 2005/0080456 | A1 * | 4/2005 | Sanbrook et al. | 606/235 |
| 2005/0222621 | A1 * | 10/2005 | Duwelius et al. | 606/235 |
| 2006/0004412 | A1 * | 1/2006 | Gilbert | 606/234 |
| 2007/0208380 | A1 * | 9/2007 | Ebner | 606/235 |
| 2007/0260280 | A1 * | 11/2007 | Dunn et al. | 606/234 |
| 2009/0069848 | A1 * | 3/2009 | Marcus et al. | 606/235 |
| 2009/0076548 | A1 * | 3/2009 | Letsche | 606/235 |
| 2009/0100866 | A1 * | 4/2009 | Creel | 63/1.11 |
| 2009/0118763 | A1 * | 5/2009 | Abramson | 606/235 |
| 2009/0287247 | A1 * | 11/2009 | Chipperson et al. | 606/235 |
| 2011/0224730 | A1 * | 9/2011 | Holley | 606/236 |
| 2012/0015980 | A1 * | 1/2012 | Fischer et al. | 514/333 |
| 2012/0016416 | A1 * | 1/2012 | Frazier | 606/235 |
| 2012/0077675 | A1 * | 3/2012 | Hungenberg et al. | 504/100 |

FOREIGN PATENT DOCUMENTS

| | | | |
|---|---|---|---|
| DE | 29704339 | U1 | 4/1997 |
| DE | 20019353 | U1 | 4/2001 |
| EP | 0321845 | A2 | 6/1989 |
| EP | 1566402 | A2 | 12/2000 |
| EP | 1566402 | A2 | 8/2005 |
| FR | 2554113 | A1 | 5/1985 |
| WO | 9220307 | A1 | 11/1992 |
| WO | WO920307 | A1 | 11/1992 |
| WO | 0078281 | A1 | 12/2000 |
| WO | WO0078281 | A1 | 12/2000 |

OTHER PUBLICATIONS

Austrian Patent Office, Search Report in Austrian Patent Application No. GM 470/2010 (Apr. 16, 2010).

* cited by examiner

*Primary Examiner* — Ryan Severson
*Assistant Examiner* — Jonathan W Miles
(74) *Attorney, Agent, or Firm* — Leydig, Voit & Mayer, Ltd.

(57) ABSTRACT

A sanitary product includes a substrate having a binder, at least one of a cross-linking agent and a curing agent, and an active ingredient.

17 Claims, 4 Drawing Sheets

PACIFIER

CROSS REFERENCE TO PRIOR APPLICATION

Priority is claimed to Austrian Patent Application No. AT GM 470/2010, filed Jul. 26, 2010.

FIELD

The present invention relates to a pacifier and to other articles such as sanitary products or materials which are designed to come into contact with the bodily fluids or skin of humans or animals.

BACKGROUND

For example, for soothers or pacifiers, also known as dummies or comforters, the calming effect on infants and young children is based on satisfying the sucking reflex. Meanwhile, adding any substances or foodstuffs to or into the pacifier has become unpopular for health reasons. Thus, the calming effect of a conventional pacifier is limited merely to sucking on a latex or silicone body, which is preferably shaped to fit the mouth and jaw and is further preferably formed with a thickening or connected to a shield or ring to prevent swallowing.

A further drawback, in particular if the pacifier is used for too long, is that the jaw geometry may be deformed and/or the tooth layout may become malpositioned (open bite). Tongue malposition and resulting speech errors are also possible. Persistent mouthbreathing also increases the risk of tooth decay and coughs and sneezes. Timely weaning which is gentle and fair to the child is thus important, but sometimes this is not particularly easy.

A further possible drawback is that the materials from which conventional pacifiers are sometimes manufactured can give off bisphenol A (BPA). This substance is suspected to be detrimental to health and genetically harmful, and, based on a further study, to be a possible cause of obesity in the population.

SUMMARY

In an embodiment, the present invention provides a sanitary product including a substrate having a binder, at least one of a cross-linking agent and a curing agent, and an active ingredient.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
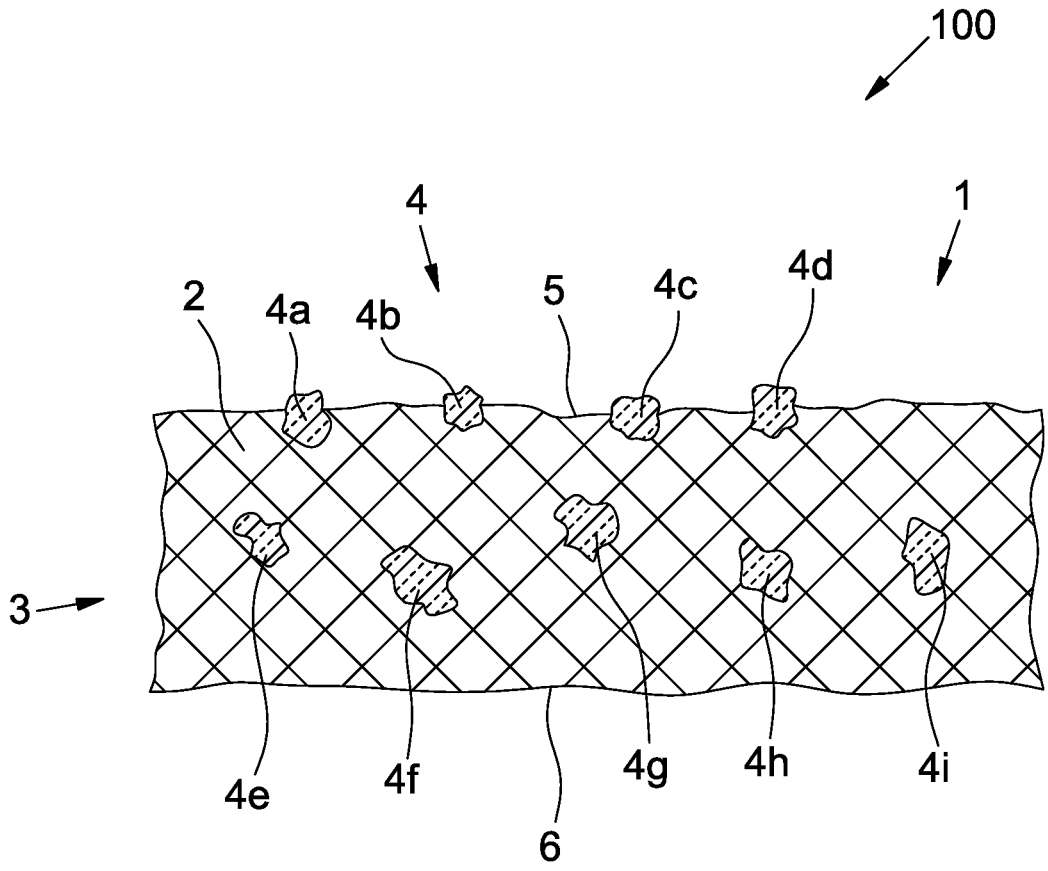
FIG. 1 is an exemplary and schematic sectional drawing through a first exemplary embodiment of a substrate according to the invention.

In an embodiment, a substrate for sanitary articles is provided, in particular for a pacifier, and embodiments of a pacifier which largely eliminate the aforementioned drawbacks. This means that not only the calming effect, but also the weaning, is improved, and the health risks are minimised.

In an embodiment, a substrate is designed and manufactured which includes at least three components. The first component is a binder, for example in the form of latex, silicone or plastics material, preferably on a natural basis or FDA-certified (US Federal Food and Drug Administration). This binder is preferably liquid and mixable with a curing agent or cross-linking agent as a second component, in a mixing ratio of binder to cross-linking agent which is in a range of 1:20 to 1:5, but preferably approximately 1:10. The third component of a substrate according to the invention is an active ingredient which according to the invention is mixed into or embedded in the binder during mixing. The ratio of binder to active ingredient is in the range of 1:100 to 1:10, but preferably approximately 1:50.

In an embodiment of a substrate according to the invention, the active ingredient is a rock flour or stone particles which form this rock flour. On a microscopic scale, the third component according to the invention of a substrate according to the invention may also be referred to in the following as an active ingredient in granulate form.

Particular types of stone can, on the one hand, lead to vibratory resonance in the body's cells, and, on the other hand, in particular in contact with saliva or even just the skin, bring about bioelectric ion exchange and/or catalytic exchange which can have a calming or even a stimulating effect on living organisms. Thus, for example, the following effects, which are generally applicable or also depend on type, are attributed to the following stones, semiprecious stones, precious stones or minerals:

Agate (a quartz): eliminates fits of anger, exam nerves, negative energies

Agate combats negative energies and helps with exam nerves and learning difficulties. It promotes sensitivity, intelligence and manual dexterity. It provides security and a feeling of comfort.

Amazonite (a feldspar): balance and harmony

Amazonite provides balance, inner peace and harmony. Mood swings disappear. It increases self-awareness. It helps to control metabolic disorders. It is beneficial for nervous and cerebral diseases. It may advantageously be used for headaches and sleep disorders involving nightmares.

Amethyst (a purple quartz): harmony, peace, blood pressure, metabolism

Amethyst is the stone for harmony, inner peace and satisfaction. It helps the skin to store moisture better, stabilises blood pressure, controls the metabolism and protects the skin.

Apatite (a phosphate mineral): self-confidence, digestion

Apatite gives self-confidence and allows relaxation. It improves perception in communication. Physically, it is associated with the small intestine, where it stimulates and promotes digestion, in particular digestion of fat.

Aragonite (a calcium carbonate): balance, calm, strength, vigour

Yellow aragonite has a balancing and calming effect on the mind. Emotional overexcitement is dissipated. Vigour is created from inner peace. Physically, it is associated with the bones and muscles. It strengthens the bones and makes the muscles stronger and more resistant to fatigue.

Aventurine (a green quartz): skin, hair

Green aventurine supports the body during skin eruptions, skin allergies, acne and spots. It vitalises skin and hair and strengthens the tissue. It promotes heart regeneration and has a purifying effect.

Rock crystal (a pure quartz): immune system, joints

Rock crystal strengthens the body's defences and lends the body new energy, boosts the immune system, improves circulation and blood flow and alleviates back and limb pains and menstrual cramps. It contributes to clear vision and helps with fevers.

Amber (a fossil resin): fever, dysentery, stomach and digestive complaints, bladder dysfunction, renal and bilious complaints, liver diseases, rheumatism When applied to the skin, amber removes anxiety and increases vitality. Amber is popular as a teething aid.

Blue calcite (a blue carbonate): bones, joints

Blue calcite reinforces the bones, strengthens the spinal discs and promotes bone growth. Calcite is invigorating in those with brittle bones. Other hard tissues in the body such as nails, hair and teeth are also reinforced.

Blue quartz (a blue quartz): headaches, migraines, flu

Blue quartz is effective against headaches and migraines. It boosts the immune system and alleviates coughs and sneezes, flu and sore throats.

Hawk's-eye (a fibrous blue-black quartz): powers of observation, ability to make decisions, clarity, nervousness Hawk's-eye makes it possible to maintain clarity and focus even in challenging and confusing situations. This stone contributes to improved powers of observation and discrimination. It alleviates restlessness and nervousness. On a physical level, hawk's-eye is used for shakiness, overreactions due to hormones, and trembling of the limbs.

Fluorite (fluorspar, a green halide): concentration, responsibility, teeth, bones, joints, skin Fluorite contributes to improved concentration and promotes willingness to learn. It may advantageously be used for regeneration of the skin and mucous membranes, including in particular the mucous membranes of the respiratory passages and lungs. It promotes healing of spots and wounds. It strengthens bones and teeth and helps with joint complaints. It keeps the locomotor system agile. It has a purifying and detoxifying effect on the skin.

Heliotrope (bloodstone, a green jasper with red flecks): control, protection, defences, internal organs Heliotrope is a precious stone with a wide range of applications. It has a protective effect and improves defences. It strengthens the body's defences against all forms of inflammation, including in the case of colds and flu. Heliotrope has a favourable effect on arteriosclerosis and should thus provide protection against cardiac infarction. It has a strengthening, positive effect on the blood vessels, the heart and the respiratory passages, and in general on all of the internal organs.

Haematite (an iron(III) oxide): vitality, liveliness, freshness, courage and perseverance Haematite purifies the aura and provides good grounding. This security provides courage, perseverance, freshness and vitality. The stone protects against the harmful effects of terrestrial radiation or water veins. In folk medicine, the stone is used in anaemia and for injuries.

Howlite (a calcium borosilicate): personal responsibility, independence, temper, equilibrium Howlite provides the strength to manage one's life with personal responsibility and independence. It has a balancing effect, and in particular assuages outbursts of anger and returns control over one's actions. On a physical level, howlite strengthens the sense of equilibrium and helps with nausea. It has a positive effect on skin irritations, in particular if they were caused by contact poisons.

Labradorite (spectrolite, a blue-green feldspar with a metallic lustre): defences, creativity, memory, happiness Labradorite generally brings happiness and reinforces inner strength, aura and perseverance. It fuels imagination and creativity and improves powers of recollection. It promotes improved processing of experiences and emotions, including in cases of mistreatment or abuse. It provides inner harmony, prevents emotional lapses such as fits of anger, and makes behaviour more balanced than in others. It helps people who react strongly to weather changes, temperature fluctuations and changes in life circumstances. Physically, it is associated with increased defences, a boosted immune system, visual impairment, rheumatism, gout, forgetfulness and digestive complaints.

Lapis lazuli (lazurite, a mineral mixture with a blue lustre): protective stone, friendship, harmony and truth Lapis lazuli is a friendship stone, which also radiates peace. It provides peaceful sleep. On a physical level, a favourable effect on fever, epilepsy, skin irritations and cramps is attributed to the stone.

Magnesite (giobertite, a magnesium carbonate): clarity, purity, satisfaction

Magnesite was often worn in Ancient Greece as a protective and healing stone, and in African cultures it was considered a fertility stone. Its pure white colour symbolises purity, clarity, innocence, freedom and fertility.

Moss agate (a chalcedonic quartz with green moss-like hornblende inclusions): tolerance, openness, agility Moss agate increases mental and physical agility, and awakens the intellect. It makes people more open to new experiences and promotes communication and inspiration. It promotes tolerance and creates the connection between man and nature. Moss agate is a lucky stone for gamblers. Physically, it is associated with agility of the locomotor system, metabolic activation, diarrhoea, water balance, pancreatic stimulation and diabetes.

Moonstone (a feldspar): vitality, youth, love, family

Moonstone is considered a "woman's stone" and is the stone of love and lovers. In Arab countries, it is the blessing stone for starting a family. It breaks down mental and emotional hardnesses, increases awareness of emotions, and brings happiness and trust. It is good on journeys. Physically, it is associated with the glandular and lymphatic system, digestive problems, gynaecological disorders, the menopause and pregnancy.

Obsidian (produced by rapid cooling of lava): memory, perception, mental trauma

Obsidian has a favourable effect on perceptiveness and powers of recollection. It is advantageously used for managing trauma. Physically, it is associated with improved circulation, cold hands and feet, muscle tension (neck, back) and pains.

Onyx (a black agate): assertiveness, self-awareness, circulation, wound healing

Onyx has been used as a protective stone since antiquity. It promotes inner harmony, character development and self-awareness. Hildegard von Bingen used it in eye disorders and stomach complaints. Physically, it is associated with the skin as well as the sense of hearing and the ears. It is also used in visual impairment.

Orange calcite (an orange carbonate): bones, joints, self-awareness

Orange calcite reinforces the bones and strengthens the spinal discs. It increases self-awareness.

Smoky quartz (a brownish crystal quartz): relaxation, realism, tensions, pains

Smoky quartz has a balancing effect and provides peace and relaxation. Physically, it dissipates muscle tensions and helps with back pains and neck tension. In general, it helps with pains and headaches and provides strong nerves.

Rose quartz (a pink-red quartz): heart, circulation, friendship, love

Rose quartz is the stone of love and the heart, and counteracts computer rays and electromagnetic waves. The stone stimulates cardiac activity and blood circulation. It improves the situation in circulatory disorders and provides good irrigation of the internal organs. It promotes skin regeneration.

Red jasper (a red quartz): circulation, purification, energy flow

Red jasper stimulates circulation, has a cell dehydration effect and boosts the immune system. It promotes detoxification of organs and has a laxative effect in digestive problems. It stimulates the energy flow and is therefore used in sexual problems. It stimulates willpower and increases dynamism.

Red carnelian (a very fine red quartz): love, partnership, circulation, sexual energy, courage Red carnelian generally stimulates bodily functions, and in particular awakens sexual energy and promotes circulation. It is considered the most important stone for combating impotence and infertility. It increases willpower, improves concentration and provides courage.

Black tourmaline (schorl, indigolite, a black silicate): stress, strain, regeneration Black tourmaline helps the body to dissipate stress and strains and stimulates the regenerating powers of the body's cells. It is a stone for diseases of the lungs and respiratory organs. It helps with asthma, bronchitis, and coughs and sneezes.

Selenite (a very high-purity gypsum): vitality, patience, peace

By clarifying and ordering the thoughts and nerves, selenite provides a basis for peace and patience, from which new energies are awakened and new vitality is born. Physically, it is associated with the nerves, the vegetative nervous system, the sexual organs and hormone production.

Sodalite (a foid): thyroid, blood pressure

Sodalite stimulates thyroid activity and promotes growth and the metabolism. This stone activates the pancreas and promotes insulin production. It is the stone for high blood pressure and reduces the demands on the heart. The lymphatic flow is activated and the immune system is boosted.

Tiger's-eye (cat's-eye, a fibrous yellow-brown quartz): courage, clear mind, mood swings Tiger's-eye makes it easier to keep a clear head and take courage in stressful situations. It provides optimism in cases of depression, and makes it possible to make clear decisions and retain clarity. It provides a clear, alert mind. Physically, it is associated with the respiratory passages, shortness of breath, joint complaints, tendon sheath inflammations and nervousness.

Petrified wood (fossilised wood converted into quartz): grounding, sense of reality, patience, obesity, circulation Petrified wood provides grounding and makes it possible to think realistically. Petrified wood stimulates the metabolism and thus helps with weight-loss. Physically, it is further associated with the circulatory system, in which it promotes clear, continuous veins free from calcifications and constrictions.

Natural calmatives, as well as natural stimulants, are further examples of substances which may, according to the invention, be considered as an active ingredient.

A further embodiment of a sanitary product or pacifier according to the invention includes, alternatively or in addition to the embedded stone particles, at least one larger stone of the same or a different type, which is also arranged in the body of the mouthpiece or is instead arranged on the rear face of the shield. This individual stone also develops the effect it provides, and additionally makes it possible to recognise the respective pacifier and match it to the effect it provides.

Further, alternatively or in addition to the embedded rock flour and/or to the individual stone or stones, a chain may be provided, which is preferably also formed from the relevant stone and is further preferably also arranged on the rear face of the shield.

A further embodiment of a sanitary product or pacifier according to the invention makes use of the principles of colour therapy, again optionally in addition to the embodiments already disclosed. For this purpose, the body of the material and/or the shield are coloured. Naturally, this also makes it possible to identify the pacifier, but also provides particular effects. For example, the colour blue has a cooling effect, for example against teething and/or fever etc.

Further, it is also possible to integrate word therapy. Naturally, the shield can for example be inscribed with the name of the child, or alternatively with "strength" for premature babies for example. Signs and symbols are also possible.

Further, in an embodiment of the invention, a sanitary product or pacifier of one of the disclosed embodiments of the present application is part of a set, which has a pacifier with the appropriate effect for the most commonly occurring cases. This set comprises for example a pacifier for stomach cramps, one for teething, one for fever, one for restlessness, one for colds and one for allergies, each appropriately characterised.

According to a further embodiment of a sanitary product or pacifier according to the invention, parts thereof are exchangeable. Thus, for example, a clamp or screw connection is provided in a pacifier and connects the body of the mouthpiece and the shield or the ring or the chain, preferably securely. In this way it is possible for example to assemble a pacifier which combines a plurality of different effects but can also be replaced only in part if required.

Further, in an embodiment of the invention, the individual particles, crystals, molecules or even atoms of the active ingredient are preferably provided with a delayed action. This can be carried out according to the invention by way of a coating or nanocoating which encases the particles and which only dissolves or breaks down after a set period of time. In this way, the effect of the active substance can be deployed with a delay if desired, but also, an effect according to the invention for promoting weaning can be provided in that an active ingredient, a colour or at least one unpleasant flavouring is released when the pacifier is so old that the child using it is clearly also too old for pacifiers or when use has continued for so long that it poses health risks.

In a further embodiment of a pacifier or sanitary product according to the invention, the active ingredient brings about or promotes the calming or stimulating effect, or in any case a first effect, for example satisfying the sucking reflex in addition to the calming effect in the case of a pacifier. In a further embodiment of a pacifier or sanitary product according to the invention, the active ingredient brings about a second effect for weaning and the calming effect of the pacifier remains limited to satisfying the sucking reflex.

A further embodiment of a sanitary product or pacifier according to the invention provides a first active ingredient as a third component of the substrate to bring about or promote the first effect and a second active ingredient as a fourth component of the substrate to bring about the second effect, for example weaning In this way, a pacifier or sanitary product may for example be produced which discolours or releases an unpleasant flavour after any desired period of the intended use, in such a way that the child or the user loses interest.

In an embodiment of the invention in conjunction with these properties, a substrate breaks down or dissolves of its own accord within a predetermined period of time. As is also the case for the aforementioned coating or nanocoating, the substrate can break down in a temporally defined manner, for example in that it reacts with a component of the air (for example nitrogen, oxygen, argon, carbon dioxide or hydrogen) or with UV radiation in a controlled manner. Slow, controlled dissolution by bodily fluid such as saliva is also possible. In this way, for example, a pacifier according to the invention can be produced which is only made for a single, adequately long daily use or else for an adequate pacifier period of several months or years for a child.

In an embodiment, on a microscopic scale, the individual particles of the third component of the substrate, i.e. the active ingredient according to the invention, or those of the aforementioned second active ingredient or fourth component of the substrate preferably are not merely embedded in the substrate or binder, and potentially completely encased within the binder during mixing because of the surface tension of the binder, but have a surface which projects out of the cured surface of the binder in part. This preferred feature of the substrate provides good exchange and can for example be provided by cutting, grinding or sandblasting the cured substrate.

A pacifier or sanitary product according to the invention can further have a surface which is enlarged by grooves. This means that raised portions and depressions, extending approximately parallel, are formed during casting. This surface enlargement can lead to improved exchange of the active substances with the saliva, bodily fluids or skin.

A second or even a third active ingredient which can be mixed into a substrate according to the invention for a sanitary product according to the invention is a bactericidal substance such as nanosilver. The sanitary product or pacifier is thus made antibacterial and does not have to be disinfected or boiled or this can be done less frequently.

The category of sanitary articles used in the present document includes not only pacifiers, but also for example suction caps for bottles, teething rings, dentures, prostheses, glasses frames and condoms, as well as massage rods, dildos and vibrators.

The described embodiments of a sanitary product or pacifier according to the invention can be combined, for example if the first active ingredient does not have a delaying coating but the second active ingredient does have one. Combinations of two or more active ingredients are possible, for example two or more types of stone. Further, the embodiments having the embedded stone particles having the extra stone and/or the stone chain and/or the colours and/or the words or symbols and having the clamp or screw connection can be individually combined.

The present application discloses a method for producing a sanitary article according to the invention having the following basic method steps:

a) mixing a binder and a cross-linking agent in a ratio which is in a range of 1:20 to 1:5, but preferably approximately 1:10, to form a liquid substrate;
b) mixing an active ingredient into the substrate in a ratio to the binder which is in a range of 100:1 to 10:1, but preferably approximately 50:1;
c) casting the mixed substrate;
d) curing the mixed substrate;
e) surface treatment of a surface of the substrate in the form of cutting, grinding or sandblasting.

When producing a sanitary article or pacifier according to the invention having a second active ingredient, which is preferably pre-treated with a delaying coating, a further method step is involved, and is inserted after the aforementioned method step a) or b).

A sanitary article or pacifier according to the invention has the following advantages:

The original effect is improved or promoted

A further effect can be brought about in addition to the original effect.

Weaning, provided at the appropriate time, is promoted by technical features.

The substrate is free from substances detrimental to health.

The substrate of the sanitary article or mouthpiece, but also the material of the shield, is antibacterial, and consequently a pacifier does not have to be disinfected or boiled or this can be done less frequently.

Further or advantageous configurations of a sanitary article according to the invention form the subject-matter of the dependent claims.

The list of reference numerals forms part of the disclosure.

The invention is described in greater detail symbolically and by way of example with reference to the figures. The figures are described in a coherent and comprehensive manner. They are schematic and exemplary drawings and are not to scale, even as regards the relationship between the individual parts. Identical reference numerals denote the same component, whilst references numerals having different indices indicate similar or functionally equivalent components.

FIG. 1 is an exemplary and schematic sectional drawing showing the composition of a substrate 1 according to the invention of a sanitary article or pacifier 100 according to the invention. A binder 2 which has already been cross-linked by a cross-linking agent 3, which cannot be shown in greater detail in the cured state shown but is merely indicated, further comprises an active ingredient 4 having individual particles 4*a*-4*i*, of which the particles 4*a*-4*d* project from a surface 5 of the substrate 1. This is because the surface 5 has optionally been sandblasted, for example, and the particles 4*a*-4*d* are harder than the binder 2. On an underside 6 of the substrate 1, no surface treatment has been carried out, and the particles 4*e*-4*i* are thus completely encased by binder 2.

The binder 2 is preferably an FDA-certified silicone and the particles 4*a*-4*i* are preferably components of a rock flour made from agate, amazonite, amethyst, apatite, aragonite, aventurine, rock crystal, amber, blue calcite, blue quartz, hawk's-eye, fluorite, heliotrope, haematite, howlite, labradorite, lapis lazuli, magnesite, moss agate, moonstone, obsidian, onyx, orange calcite, smoky quartz, rose quartz, red jasper, red carnelian, black tourmaline, selenite, sodalite, tiger's-eye or fossilised wood.

Figure 2:
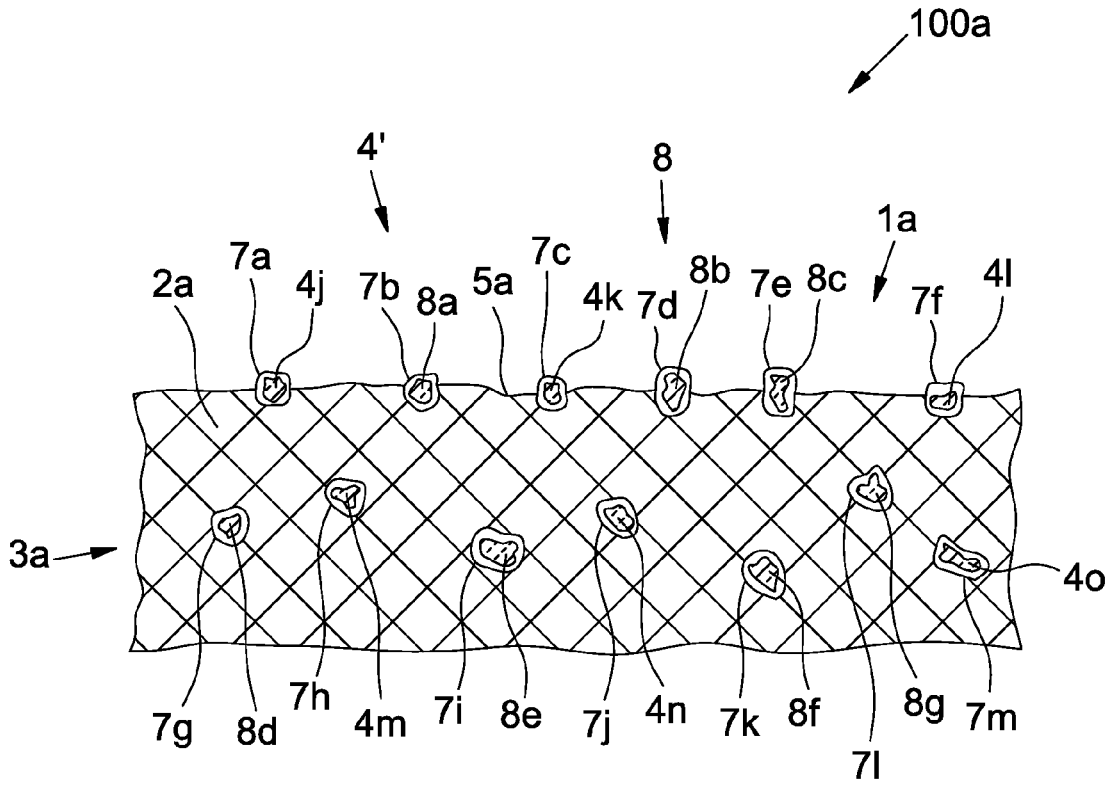
FIG. 2 is also a schematic sectional drawing and shows an exemplary second embodiment of a substrate according to the invention having a second active ingredient.

FIG. 2 is a schematic sectional drawing of a second embodiment of a substrate 1*a* according to the invention for a sanitary article or pacifier 100*a*. The substrate 1*a* comprises a binder 2*a* which has already been cross-linked with a cross-linking agent 3*a*, which is merely indicated, and the substrate la further comprises a first active ingredient 4' and a second active ingredient 8.

The first active ingredient 4' comprises individual particles 4*j*-4*o*, of which the particles 4*j*-4*l* project from a surface 5*a* of the substrate la because of a surface treatment of the substrate 1*a*. The second active ingredient 8 comprises individual particles 8*a*-8*g*, of which the particles 8*a*-8*c* also project from the surface 5*a* of the substrate 1*a*.

The individual particles 4*j*-4*o* of the first active ingredient 4' as well as the individual particles of the second active ingredient 8 are pre-treated in such a way that they are encased by a coating 7*a*-7*m*. These coatings 7*a*, 7*c*, 7*f*, 7*h*, 7*j* and 7*m* may break down or dissolve in a different manner from the coatings 7*b*, 7*d*, 7*e*, 7*g*, 7*i*, 7*k* and 7*l*, in such a way that the effects or effect reinforcements of the first active ingredient 4' and the second active ingredient 8 set in at different times.

Figure 3:
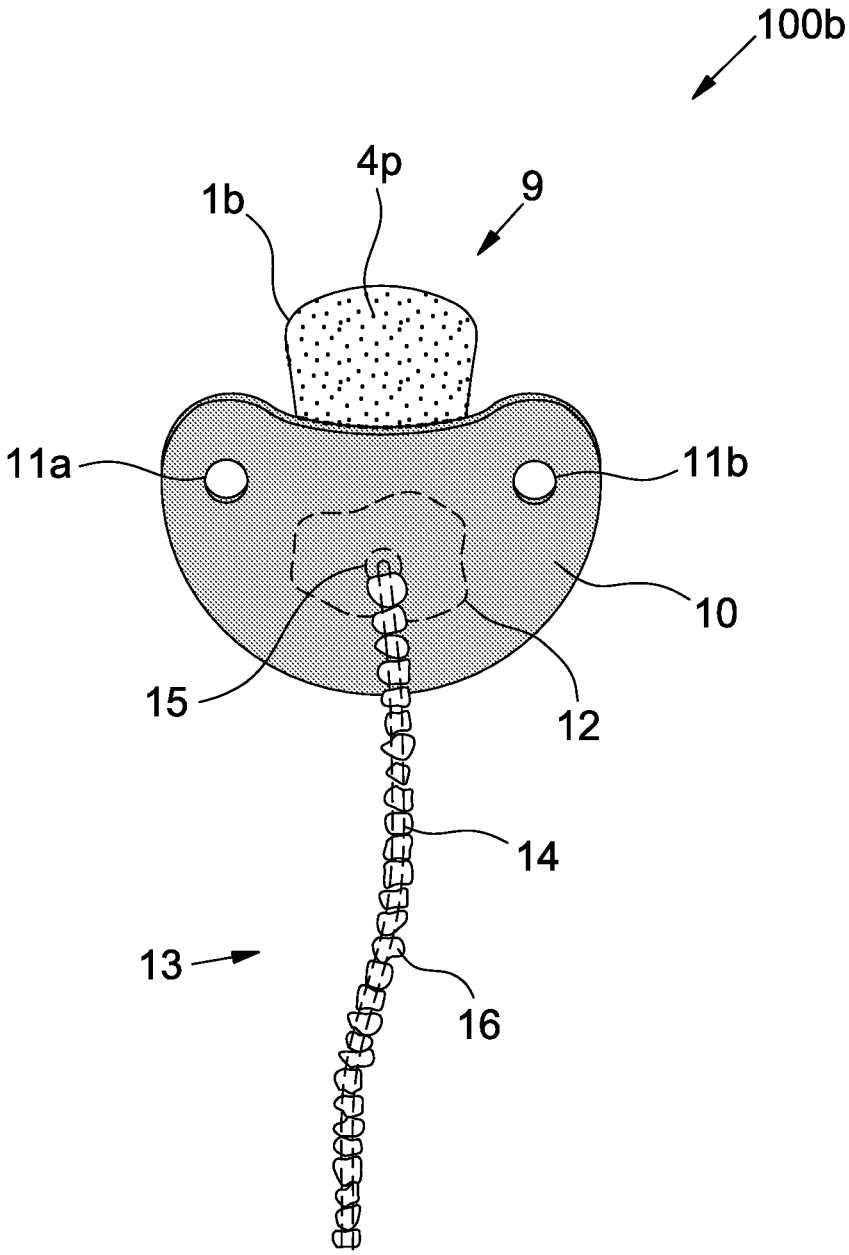
FIG. 3 shows an exemplary first embodiment of a pacifier according to the invention.

FIG. 3 is a schematic drawing of a first exemplary embodiment of a pacifier 100*b* according to the invention, which comprises a mouthpiece 9 and a shield 10. The mouthpiece 9 is formed from a substrate lb comprising individual stone particles 4*p* and is connected to the shield 10, which comprises two air-holes 11*a* and 11*b*.

A stone 12, in which a cord 14 is fixed via an anchor 15, is cast within the shield 10. A stone chain 13 is formed by stringing individual stone chain members 16 onto the cord 14. The stone 12 may be cast completely within the material of the shield 10, or may alternatively merely be inserted, in such a way that a surface of the stone 12 is left free. Alternatively or in addition to the stone chain 13, a ring may also be guided through an aperture in the stone 12 and/or through an aperture in the holder thereof The shield 10 is shown coloured grey, to indicate that it can be coloured with any desired colour. This is preferably a colour having a colour therapy effect. Alternatively or in addition, words or symbols may also be arranged on the shield 10.

Figure 4:
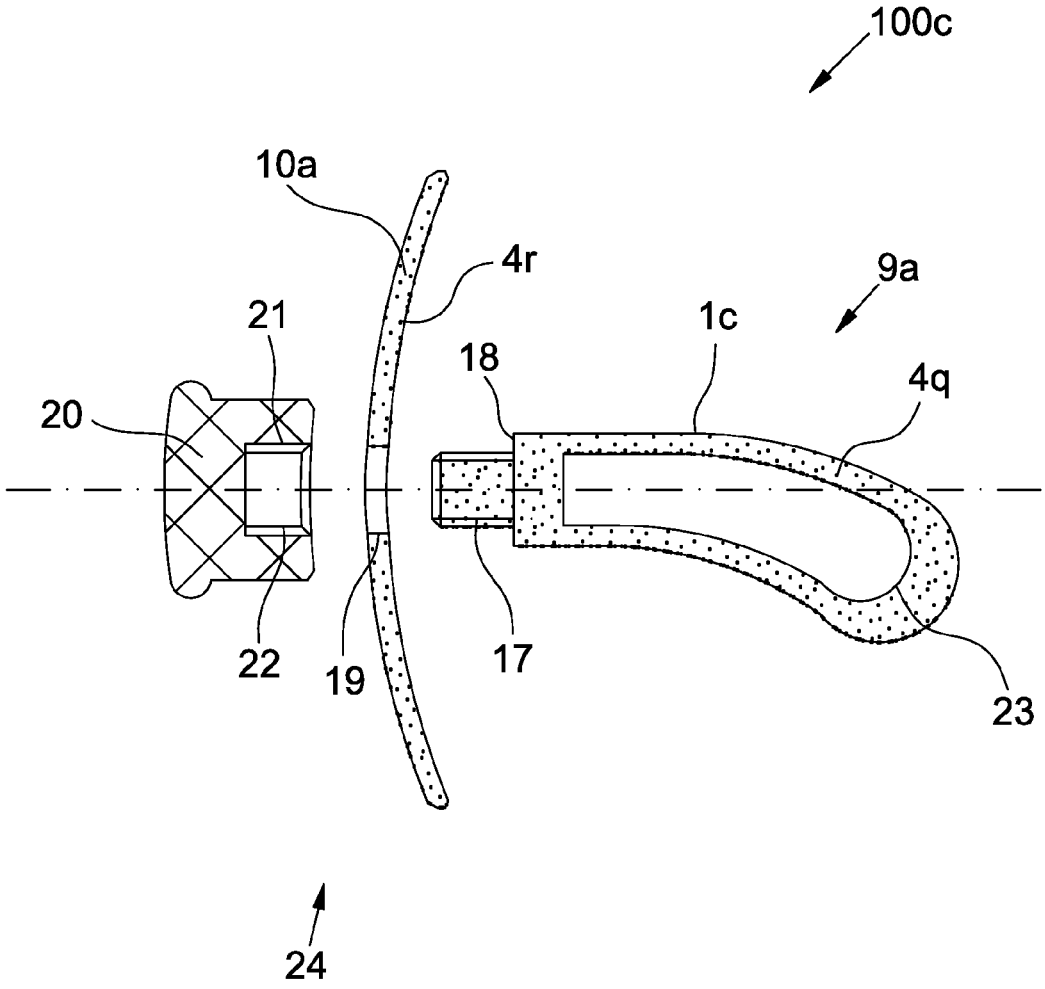
FIG. 4 shows an exemplary second embodiment of a pacifier according to the invention.

FIG. 4 is a likewise schematic, partially sectional drawing of a second exemplary embodiment of a pacifier 100*c* according to the invention, which comprises a mouthpiece 9*a*, a shield 10*a* and a fixing nut 20.

The mouthpiece 9*a* is formed from a substrate 1*c* comprising individual stone particles 4*q* and thus forms a hollow space 23. Further, the mouthpiece 9*a* comprises a thread 17, over which the shield 10*a* can be placed via a central opening 19 until it reaches a shoulder 18. Subsequently, the fixing nut 20 having an aperture 21 having an internal thread 22 can be screwed onto the thread 17. In this way a releasable clamp or screw connection 24 is provided and it is thus possible to combine any desired mouthpieces 9*a* with any desired shields 10*a*, including those with or without an individual stone or a stone chain.

Optionally, the shield 10*a* may also comprise embedded stone particles 4*r*.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

1, 1*a*-1*c*—substrate
2, 2*a*—binder, latex, silicone, plastics material
3, 3*a*—cross-linking agent, curing agent
4, 4'—first active ingredient, first rock flour
4*a*-4*r*—individual particles of 4 and 4'
5, 5*a*—surface of 1, 1*a*
6—underside of 1
7*a*-7*m*—coating, nanocoating
8—second active ingredient, second rock flour
8*a*, 8*g*—individual particles of 8
9, 9*a*—mouthpiece
10, 10*a*—shield or ring
11*a*, 11*b*—air-hole
12—stone
13—stone chain
14—cord
15—anchor
16—stone chain member
17—thread
18—shoulder
19—central opening
20—fixing nut
21—aperture
22—internal thread
23—hollow space
24—clamp or screw connection
100*a*, 100*a*-100*c*—sanitary product, pacifier

The invention claimed is:

1. A pacifier comprising:
a substrate including:
a binder,
at least one of a cross-linking agent and a curing agent, and
an active ingredient, wherein the active ingredient includes at least one of a rock flour and a granulate having individual particles of at least one of agate, amazonite, amethyst, apatite, aragonite, aventurine, rock crystal, amber, blue calcite, blue quartz, hawk's-eye, fluorite, heliotrope, haematite, howlite, labradorite, lapis lazuli, magnesite, moss agate, moonstone, obsidian, onyx, orange calcite, smoky quartz, rose quartz, red jasper, red carnelian, black tourmaline, selenite, sodalite, tiger's-eye and petrified wood.

2. The pacifier as recited in claim 1, wherein the binder and the at least one of a cross-linking agent and a curing agent are FDA-certified and are mixed in a binder to agent ratio in a range of 1:20 to 1:5, and wherein the binder and the active ingredient are mixed in a binder to active ingredient ratio in a range of 1:100 to 1:10.

3. The pacifier as recited in claim 2, wherein the binder to agent ratio is 1:10 and the binder to active ingredient ratio is 1:50.

4. The pacifier as recited in claim 1, wherein the sanitary product includes an individual stone of at least one of the agate, amazonite, amethyst, apatite, aragonite, aventurine, rock crystal, amber, blue calcite, blue quartz, hawk's-eye, fluorite, heliotrope, haematite, howlite, labradorite, lapis lazuli, magnesite, moss agate, moonstone, obsidian, onyx, orange calcite, smoky quartz, rose quartz, red jasper, red carnelian, black tourmaline, selenite, sodalite, tiger's-eye and petrified wood.

5. The pacifier as recited in claim 1, further comprising a stone chain including individual stone chain members.

6. The pacifier as recited in claim 1, wherein the sanitary product is a pacifier including at least one of a mouthpiece and a shield inscribed with at least one of a word and a symbol.

7. The pacifier as recited in claim 1, wherein the sanitary product is included in a set of sanitary products.

8. The pacifier as recited in claim 1, wherein the sanitary product is a pacifier including a mouthpiece and a shield, wherein at least one of a releasable clamp and a screw connection is disposed between the mouthpiece and the shield.

9. The pacifier as recited in claim 1, wherein the particles of the active ingredient include a coating.

10. The pacifier as recited in claim 9, wherein the active ingredient is configured provide at least one of a coloring and a flavoring after the coating dissolves.

11. The pacifier as recited in claim 1, wherein the substrate is configured to be dissolved by at least one of saliva, a component of air and ultraviolet (UV) radiation.

12. The pacifier as recited in claim 1, wherein the particles of the active ingredient project from a surface of the substrate.

13. The pacifier as recited in claim 1, wherein the sanitary product is a pacifier including a shield, and wherein at least one of the substrate and a material of the shield include surface-enlarging grooves.

14. The pacifier as recited in claim 1, wherein the sanitary product is a pacifier including a shield, and wherein at least one of the substrate and a material of the shield include at least one bactericidal substance.

15. A method for producing a pacifier, the method comprising:

mixing a binder and a cross-linking agent in a binder to agent ratio in a range of 1:20 to 1:5 so as to form a liquid substrate;

mixing a first active ingredient into the liquid substrate at a binder to first active ingredient ratio in a range of 1:100 to 1:10 so as to provide a mixed substrate;

casting the mixed substrate;

curing the mixed substrate; and treating a surface of the mixed substrate by at least one of cutting, grinding and sandblasting, wherein the first active ingredient includes at least one of a rock flour and a granulate having individual particles of at least one of agate, amazonite, amethyst, apatite, aragonite, aventurine, rock crystal, amber, blue calcite, blue quartz, hawk's-eye, fluorite, heliotrope, haematite, howlite, labradorite, lapis lazuli, magnesite, moss agate, moonstone, obsidian, onyx, orange calcite, smoky quartz, rose quartz, red jasper, red carnelian, black tourmaline, selenite, sodalite, tiger's-eye and petrified wood.

16. The method as recited in claim 15, further comprising mixing a second active ingredient having a delaying coating into the liquid substrate at least one of after the mixing the binder and the cross-linking agent step and the mixing the first active ingredient into the liquid substrate step.

17. A pacifier comprising:

a substrate having an active ingredient that includes rock flour particles.

* * * * *